United States Patent [19]

Vandagriff

[11] 4,396,050

[45] Aug. 2, 1983

[54] LOG PREPARATION FOR VENEER PEELING

[76] Inventor: Ralph L. Vandagriff, 1313 N. Hills Blvd., Bldg. 310, North Little Rock, Ark. 72216

[21] Appl. No.: 178,607

[22] Filed: Aug. 15, 1980

[51] Int. Cl.[3] ..... B27M 1/00

[52] U.S. Cl. ..... 144/380; 34/13.8; 432/1; 432/5; 144/365

[58] Field of Search ..... 144/208 B, 340, 361, 144/380, 329, 365; 432/1, 5; 34/13.4, 13.8, 16.5

[56] References Cited

U.S. PATENT DOCUMENTS

| | | | |
|---|---|---|---|
| 146,370 | 1/1874 | Taylor | 144/271 |
| 148,752 | 3/1874 | Pine | 144/271 |
| 992,114 | 5/1911 | Curry | 144/271 |
| 1,117,923 | 11/1914 | Stiles | 144/271 |
| 1,166,819 | 1/1916 | Derby et al. | 34/16.5 |
| 1,261,445 | 4/1918 | Schreibman | 144/271 |
| 1,366,225 | 1/1921 | Weiss | 34/13.4 |
| 1,386,727 | 8/1921 | Pfleumer et al. | 427/441 |
| 1,386,930 | 8/1921 | Holm | 144/208 B |
| 2,414,808 | 1/1947 | Hamill | 144/380 |
| 2,668,779 | 2/1954 | Herman | 427/297 |
| 2,973,793 | 3/1961 | Irvine | 144/380 |
| 3,030,711 | 4/1962 | Warring | 34/73 |
| 3,114,539 | 12/1963 | Wilson et al. | 432/5 |
| 3,403,452 | 10/1968 | Stem et al. | 34/13.8 |
| 3,448,530 | 6/1969 | Mortensen | 34/13.8 |
| 3,716,087 | 2/1973 | Tuuha | 144/208 B |
| 3,750,303 | 8/1973 | Gates et al. | 34/201 |
| 3,778,221 | 12/1973 | Bloom | 432/11 |
| 4,047,886 | 9/1977 | Heyraud | 432/128 |
| 4,108,226 | 8/1978 | Bornstein | 144/380 |

FOREIGN PATENT DOCUMENTS

| | | | |
|---|---|---|---|
| 1165836 | 3/1956 | Fed. Rep. of Germany | 144/340 |
| 1275271 | 3/1965 | Fed. Rep. of Germany | 144/340 |
| 2520939 | 4/1976 | Fed. Rep. of Germany | 144/208 D |
| 1130593 | 10/1956 | France . | |
| 209700 | 4/1968 | U.S.S.R. | 144/340 |

*Primary Examiner*—W. D. Bray

*Attorney, Agent, or Firm*—Cushman, Darby & Cushman

[57] ABSTRACT

In a semi-batch practice of the process, the logs are plasticized using hot, pressurized alkaline liquid in a closed chamber having a preceding charging chamber and a succeeding unloading chamber. The chambers are selectively flooded and emptied to facilitate operations. A ram is used at the charging end to advance the logs. Spacers are placed in opposed pairs between successive charges. The unloading trough is equipped with a sling to facilitate advancement of the conditioned logs to the lathe. Process may be program-controlled, with monitoring of processing temperature, pressure, time, pH, processing solution constituency, and heat input. Additional variables may be input to the automatic controller, such as species, ambient log temperature, length of time since log harvest, veneer end-product (e.g. thickness and whether decorative quality is needed), log weight and log diameter. The process may also be more simply conducted in batchwise fashion.

36 Claims, 19 Drawing Figures

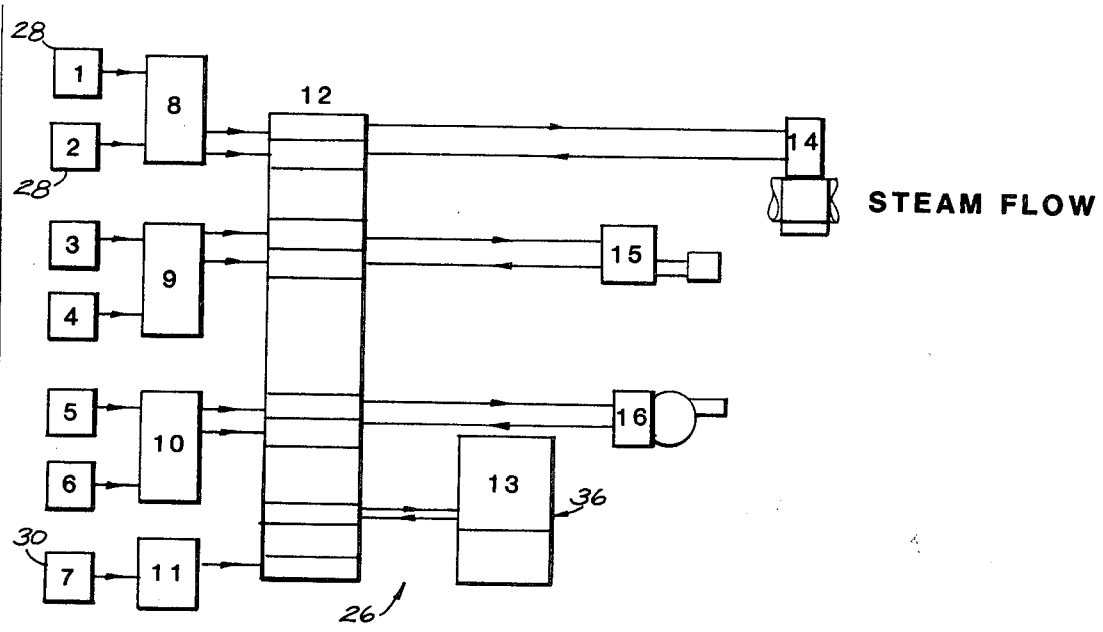

1. Temperature transmitter (flow into cooker)
2. Temperature transmitter (flow from cooker)
3. pH transmitter (into cooker)
4. pH transmitter (from cooker)
5. Flow transmitter (flow into cooker)
6. Flow transmitter (flow out of cooker)
7. Pressure transmitter (pressure in cooker)
8,9,10, and 11. Manual/Auto Station-Analog
12. Signal Conditioning Rack, Analog, RTD Converter
13. Computer Control Center
14. Valve Controller, steam flow to heat exchanger
15. pH Metering Pump Controller
16. Motor Control, Flow Control Pump

Fig. 2

TO FIG. 2 CONT.

Fig. 2 CONT.

START UP & RUN

1. Computer power on.
2. SCR power on.
3. System power on.
4. #1 and #2 send signal through #8 to #12 indicating low effluent temperature, #12 signals #14 to open, sending more steam to heat exchanger.
5. #3 and #4 start monitoring pH, send signal through #9 to #12, #12 signals #15 to add or not to add pH control chemical to effluent.
6. #5 and #6 monitor flow, send signal through #10 to #12 and #13, #13 correlates all signals and sends signal through #12 to #16 increasing or decreasing flow.
7. #7 sends signal through #11 to #12 and #13. Data input only.

RUN

As variables monitored by #1,#2,#3,#4,#5,#6 ,and #7 change, #13 matches the input with the data stored, compares setpoints and sends signals to #12 for proper action. Data input during run cycle is stored for reference and referral.

LOG PREPARATION FOR VENEER PEELING

BACKGROUND OF THE INVENTION

It is well known that there is an ideal temperature range and degree of plasticization for peeling veneer from logs, blocks or bolts, (generically "logs") of various wood species, varying from room temperature, to about 200° F., and various methods have been proposed and are in use for conditioning the logs. The conditioning process being used can itself introduce problems that will affect the peeling operation and the quality of the veneer produced.

Because of the nature of the cellular structure of wood, heating and cooling proceed about two and one half times faster in the longitudinal direction from the ends towards the middle than in the radial direction from the outer diameter towards the core. Thus, too rapid heating if unaccompanied by sufficient tempering can result in logs having some portions that are too highly plasticized and other portions that are insufficiently conditioned. Slow conditioning can increase end splits and discolor the wood. Nosebar adjustments at the peeling lathe can accommodate some differences in degree of plasticization but in general, if in spite of these adjustments the veneer is loosely cut a higher log temperature or longer heating period is indicated and if there is fuzzy cutting about the whole circumference of the log a lower log temperature or shorter heating period is indicated, as the log has been over-softened.

Although some plywood mills run the same species, diameter, quality and degree of freshness of logs for weeks on end, it is more typical that a mill, over time, will face an input of various species and logs of varying diameter, quality and length of time since harvesting, for which the ideal conditioning parameters will correspondingly vary.

The present inventor is most acquainted with the practices at Southern plywood mills in the United States and came to consider the need for the present invention in connection with surveying the energy requirements of one or more of such mills in the course of studying ways to reduce energy input requirements as existing plants are kept in adequate repair and modernized. Of course the principles of the invention are equally applicable to mills being newly constructed.

In the experience of the present inventor, practically every Southern plywood mill uses some means for heating logs prior to peeling veneer from them while at elevated temperature. And of the log conditioning processes currently in commercial use, it appears that most often, the conduct of the heating process, whether it be by steam, or live steam mixed with water, or steam and dryer condensate, or steam and press condensate and boiler blowdown, little attention is given to maintenance and proper conduct during long periods of fairly continuous periods of operation between down times for maintenance and repair. In a way, the log heating operation is the orphan child of the typical mill. While the operators continue to go through the motions of block preparation, as deterioration sets in and debris accumulates, the conditioning is less and less ideally performed but typically no one does anything about it until the point of near total failure is reached, when the capital outlay required for refurbishing or replacement of the deteriorated log conditioning system is staggering, and may not be available.

Most of the Southern mills use simple soaking vats in which the logs are stepped in heated liquid. Others use shedded-over drive-in vaults, (or less typically) treatment tunnels with a series of interior chambers partially segregated from one another by hanging curtains.

Fifty percent or more of the mills in the present inventor's experience move their blocks through a liquid in soaking vats. These vats have problems of flow interruption and jamups, which can be coped with by adjusting the liquid level control and by having either crane-type hoists or other hoists handy to pull blocks in case of jamups or damage to the conveying equipment. If the soaking vat is heated by coils immersed in the bottom of the vat or if live steam is injected through drilled lines, it is, of course, necessary to keep these free from debris and trash. Often the trash and debris is not removed with sufficient frequency to insure that the maximum heat penetration, and thus the maximum yield potential, is being achieved. So what one sees when one inspects the vats is an accumulation of debris over the lines in the bottom of the vat through which the water or steam must pass, and water lines in the center of the floor covered by debris. Conditions vary from mill to mill. One line may be covered with debris and another may be open. Steam lines can br torn or plugged or have broken nozzles, vat doors may be missing, hanging curtains torn; dry kiln doors may have been ruined by fork-lift operators. The result of all this is that blocks may be hotter on the top tier than on the bottom tier, blocks may be progressively cooler from end to end, blocks may vary from one vat to another in degree of conditioning and blocks may be hotter at the back of the vat than at the front. Under these conditions, one loses yield and creates problems that are carried all the way through the mill, in long drying schedules, in redry, in long pressing schedules, and in a very low percentage when it comes to shear tests, in increased clipper loss, in drying downgrade and in higher reclip. All these problems are aggravated by poor housekeeping.

One characteristic of soaking vats is the high acidity that comes about by the continuous reuse of the soaking liquid. Testing of these vats has shown pH as low as 3.5. This limits yield, because it increases the brittleness of the fiber, resulting in breaking of the fiber and deeper lathe checks than would have been the case if the blocks had not moved through this acid bath. In addition, the acid contributes to dissolving of the steam line, dissolving of the conveyor linkages, and dissolving of the lathe chucks.

In its natural state wood is acidic. That is what contributes to the strength and brittleness of the fibers. The average composition of wood is 25% lignin, 25% hemicelluloses and 50% cellulose; lignin and hemicelluloses are thermoplastic, that is, they are softened by heat. So when the block is subjected to heat, 50% of the block is naturally softened. The other 50%, the cellulose portion, is acid and is not softened by heat. It remains brittle, breaks rather than cuts, and this contributes to deep lathe checks.

It is known that in an alkaline environment, the cellulose comprising the other approximately 50% of the typical log also becomes plasticized during conditioning. An alkaline environment, say with a pH of 9, for example, softens the cellulose so that it can be cut rather than broken and reduces the depth of lathe checks. Since the blocks are acidic, they soak up this alkaline solution just like a sponge. The alkali saponifies the impacted resins so they wash out of the block. The penetration of heat is more uniform, so in rotary peeling a solid ribbon can be peeled all the way to the core, with the exception of tipple breaks and jamups. Using an alkaline solution means that one can cut a full ribbon all the way down to a 4 inch core. It means the D full sheets stay intact all the way down the line through the dryer. It means uniform heat penetration end-to-end throughout the length of the block. It means a narrow moisture band and no breaks as the peel enters a knot area. It means the knots will not crumple and fall out and ring knots will not break. Thus this type of treatment can reduce clipper loss, reduce dryer falldown, reduce redry, reduce reclip and reduce waste. Complete block plasticization has much to offer in terms of increased yield, over the best that can be achieved with existing processes which are carried out under acidic conditions. To compare a steam and water system with wet alkaline steam at pH of 9, tests were run on southern pine veneer blocks under equal and controlled mill conditions. The vats were cleaned and in good repair. The tests were run in the summer so the results are considered to be conservative for year-around use. Panel yield from a wet alkaline process exceeded yield from the steam and water process by 7 percent. To determine dollar value, cost analysis of southern pine industry figures for 1973 were used. The cost of wood alone was reduced $2.73 per thousand square feet. If viewed as production increase and green end labor is distributed over the increased volume, it is greater and if one uses the yield increase as increased production and distribute it over fixed costs and overhead in addition to green-end labor, the return is at maximum.

The energy losses encountered in conducting typical prior art log conditioning processes leave much room for improvement. Plywood and veneer mills surveyed by the present inventor which use soaking vats acknowledge a loss of about 50 percent of B.T.U. input due to evaporation and other heat transfer to outside the system; for those mills using vaults, the reported B.T.U. loss is 30–50 percent. This loss runs from $82,000.00 to $108,000.00 per year for every five vats in use, at present fuel prices. So few mills use the tunnel conditioning of Gates et al., U.S. Pat. No. 3,750,303, issued Aug. 7, 1973, that the present inventor has been unable to find reported B.T.U. loss statistics covering use of that system.

Problems with maintenance of prior art log conditioning systems include the following:

A. VAT-TYPE SYSTEM

1. Debris clogs the steam and/or hot water inlets.
2. Logs break heating pipes.
3. The conveyor chains break.
4. The conveyor chains lock-up due to wedging-in of trash, and trash accummulation.
5. High acidity corrodes metal parts exposed to vat liquid carried downstream in process with the conditioned logs.

B. VAULT-TYPE SYSTEM

1. Vault doors are ruined by being roughly opened and closed by using fork-lifts, causing excessive leakage.
2. Heating lines are broken by logs.
3. Steam nozzles are broken by logs or by fork-lift operators.
4. Nozzles without filters become plugged.

C. TUNNEL-TYPE SYSTEM

1. Log jamups tear baffles.
2. Nozzles and lines are broken by impact of cross logs and log jams.
3. Log chains jam and break.
4. There are many parts which are easily damaged or which wear-out before a general overhaul would otherwise be needed.

SUMMARY OF THE INVENTION

It is the principal object of the present invention to provide a log conditioning system which avoids many of the above-outlined output, maintenance, energy-loss and adaptability shortcomings of the prior art log conditioning systems.

In a semi-batch practice of the process, the logs are plasticized using hot, pressurized alkaline liquid in a closed chamber having a preceding charging chamber and a succeeding unloading chamber. The chambers are selectively flooded and emptied to facilitate operations. A ram is used at the charging end to advance the logs. Spacers are placed in opposed pairs between successive charges. The unloading trough is equipped with a sling to facilitate advancement of the conditioned logs to the lathe. Process may be program-controlled, with monitoring of processing temperature, pressure, time, pH, processing solution constituency, and heat input. Additional variables may be input to the automatic controller, such as species, ambient log temperature, length of time since log harvest, veneer end-product (e.g. thickness and whether decorative quality is needed), log weight and log diameter. The process may also be more simply conducted in batchwise fashion.

The principles of the invention will be further discussed with reference to the drawings wherein preferred embodiments are shown. The specifics illustrated in the drawings are intended to exemplify, rather than limit, aspects of the invention as defined in the claims.

BRIEF DESCRIPTION OF THE DRAWING

FIG. 2 is a schematic representation of a rudimentary program for automatically controlling the log conditioning system, showing how the various monitored and keyed-in inputs affect operation of the system.

DETAILED DESCRIPTION

Figure 1:
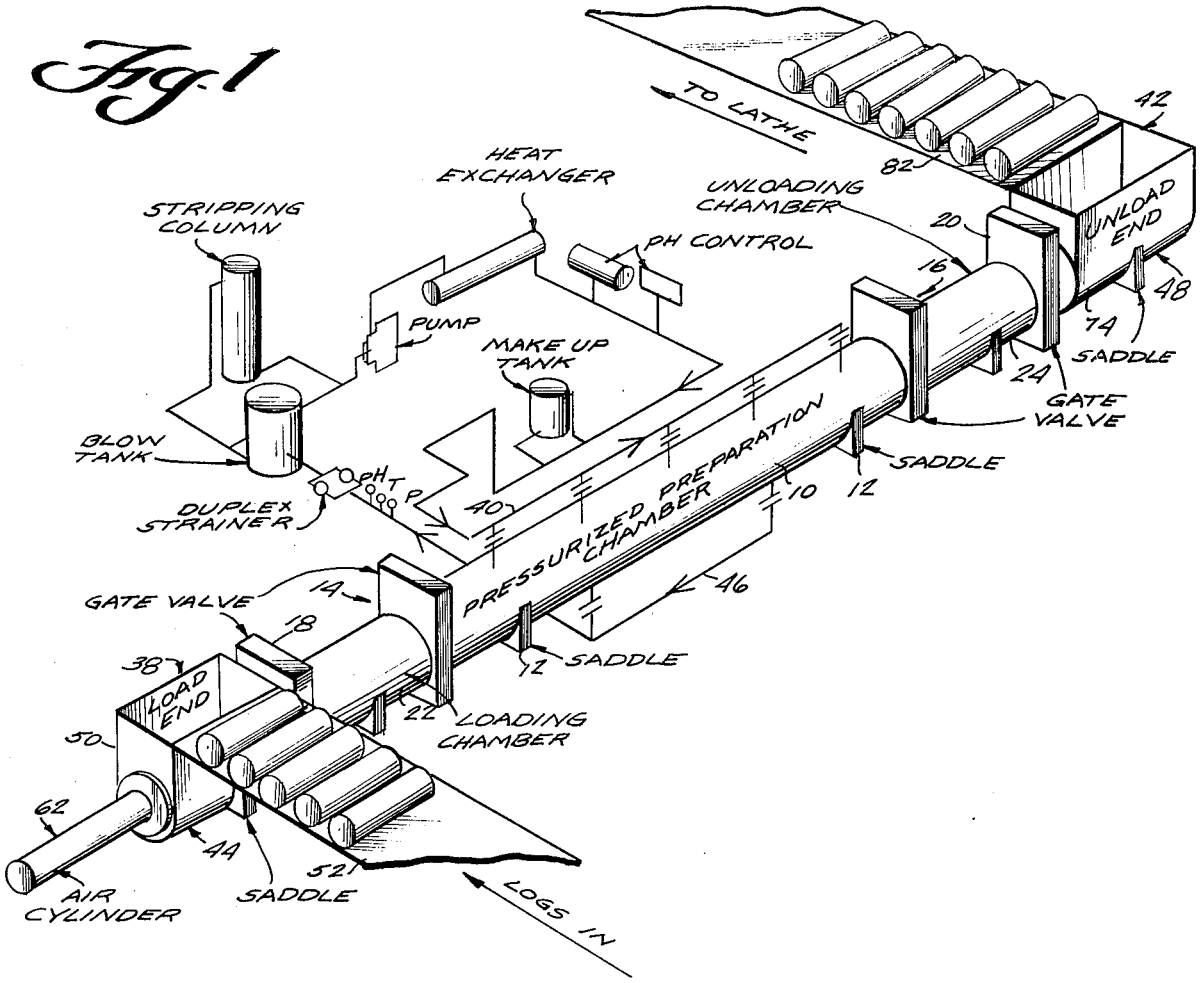
FIG. 1 is a typical flow diagram of a veneer peeling process equipped with a log conditioning system in accordance with principles of the present invention. In this figure, the parts of the process upstream and downstream of the system of the present invention are shown in less detail.
Figure 3:
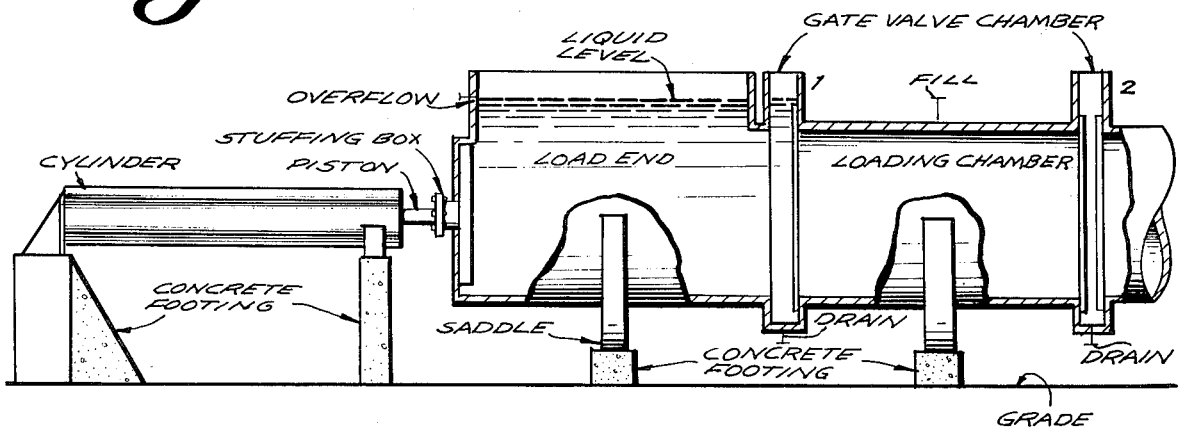
FIG. 3 is a fragmentary side elevation view of the input end of the log conditioning system.
Figure 4:
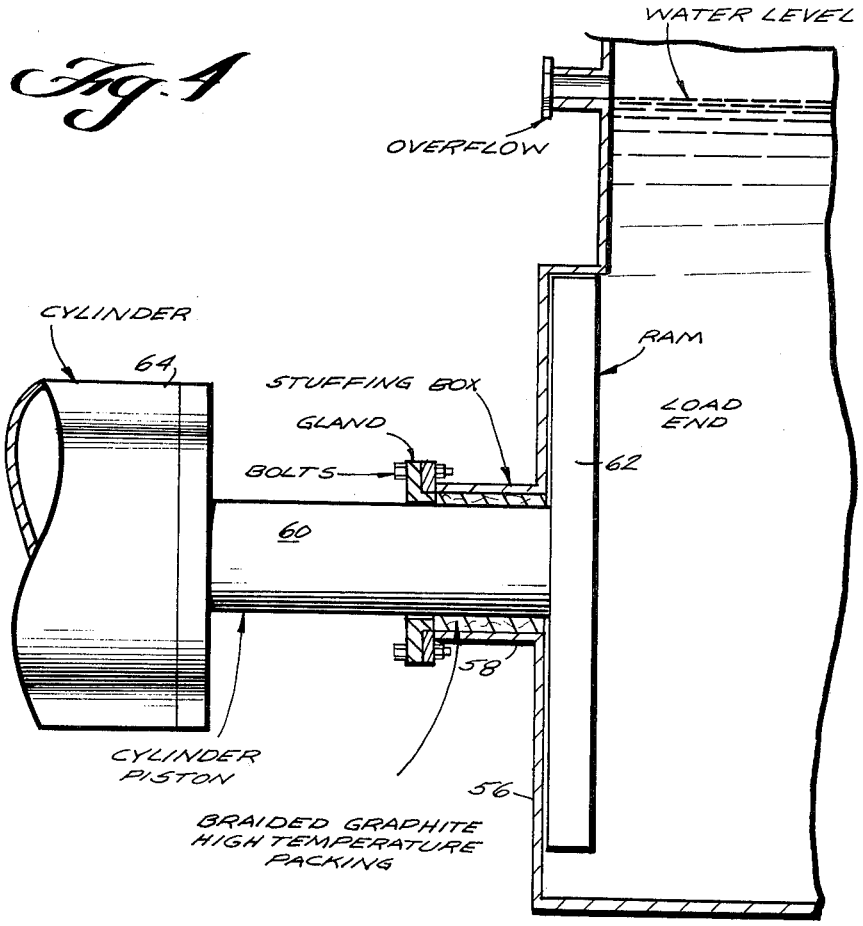
FIG. 4 is a larger scale fragmentary sectional view of a portion of the input end of the log conditioning system.
Figure 5:
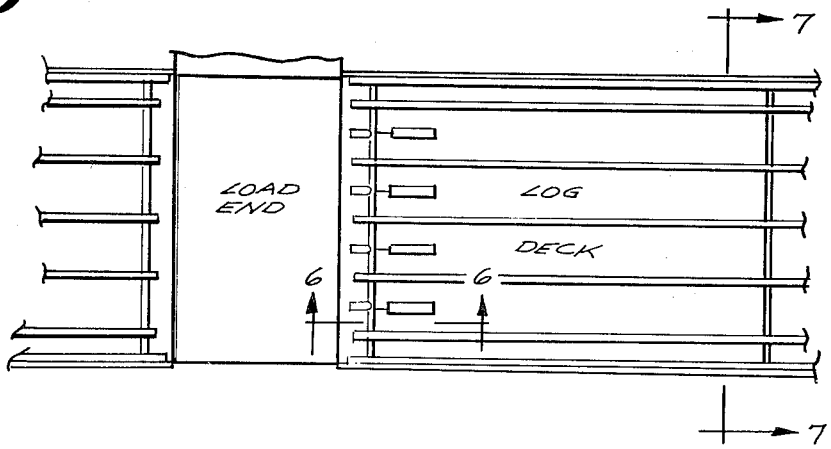
FIG. 5 is a fragmentary top plan view of the input end showing the log deck with its gate.
Figure 6:
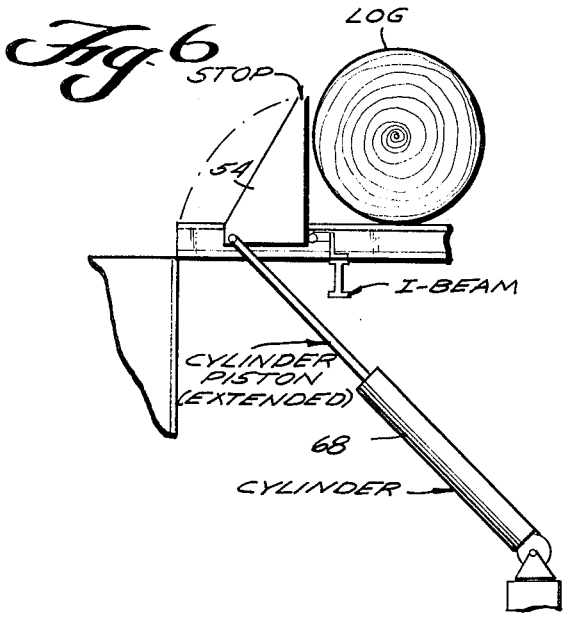
FIG. 6 is a fragmentary sectional view thereof taken substantially on line 6—6 of FIG. 5.
Figure 7:
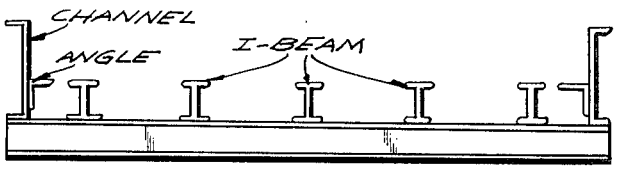
FIG. 7 is another fragmentary sectional view thereof taken substantially on line 7—7 of FIG. 5.
Figure 8:
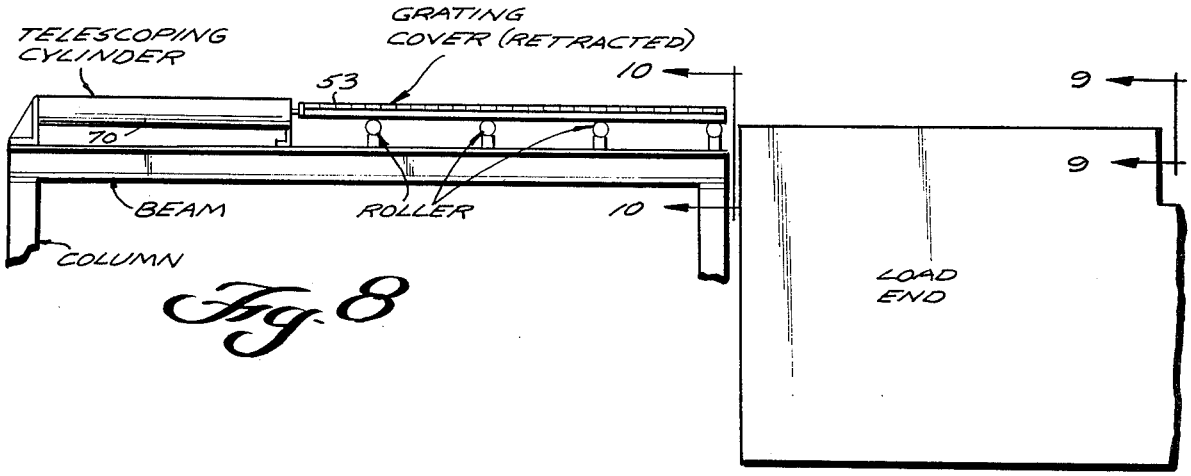
FIG. 8 is a fragmentary side elevational view of the input end of the log conditioning system, illustrating the sliding cover for the load end (a similar cover is provided for the unload end)
Figure 9:
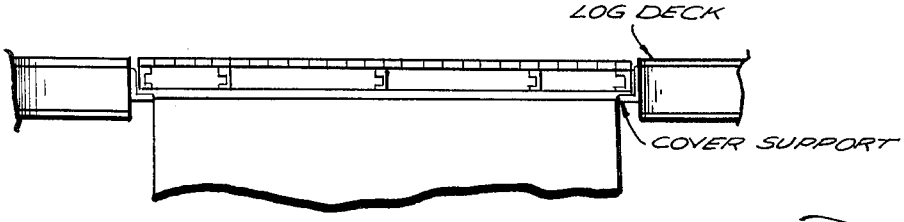
FIG. 9 is a fragmentary sectional view taken substantially on line 9—9 of FIG. 8.
Figure 10:
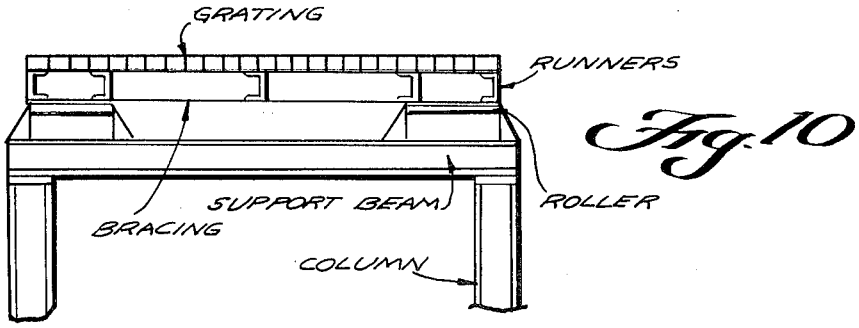
FIG. 10 is another fragmentary sectional view taken substantially on line 10—10 of FIG. 8.
Figure 11:
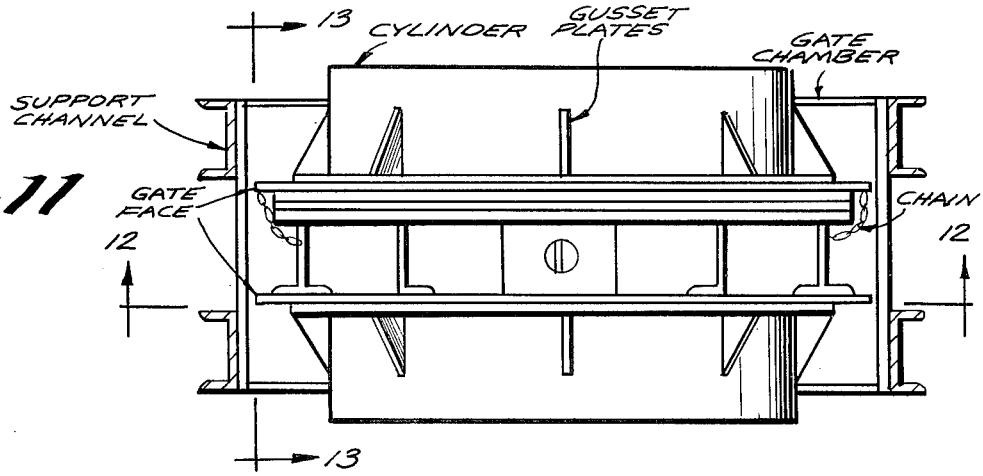
FIG. 11 is a top plan view of an exempliary one of the gate valves shown in FIG. 1.
Figure 12:
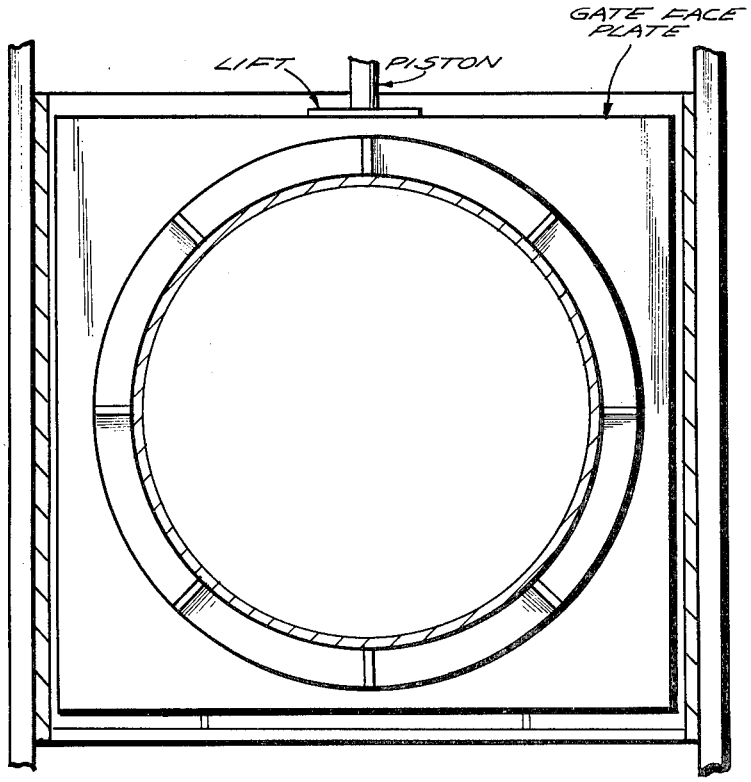
FIG. 12 is a fragmentary sectional view taken substantially on line 12—12 of FIG. 11.
Figure 13:
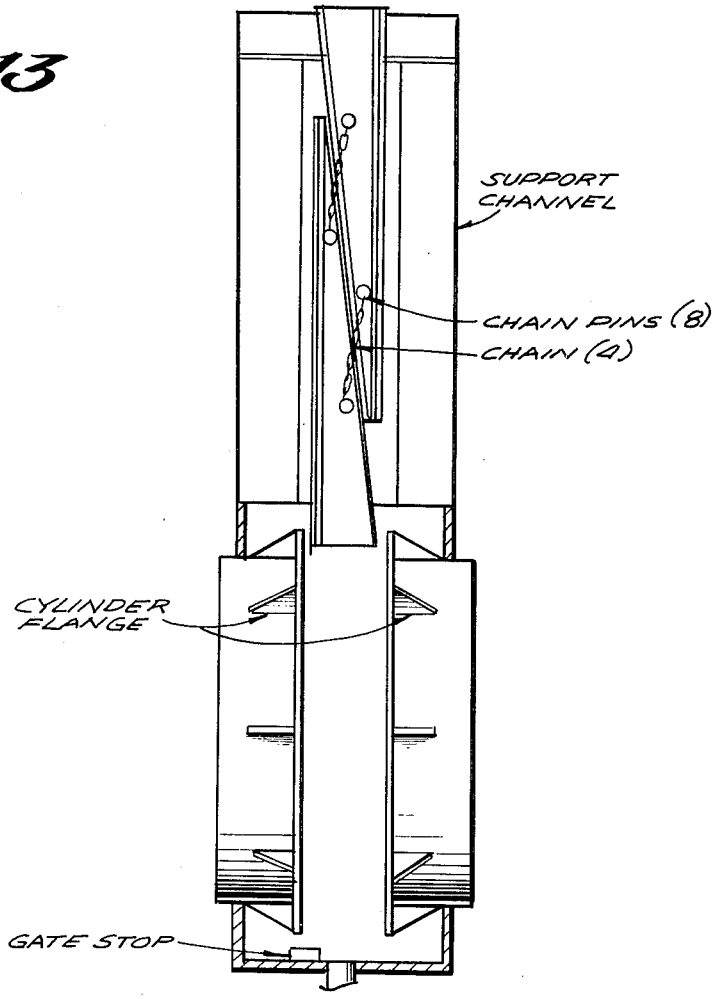
FIG. 13 is another sectional view taken substantially on line 13—13 of FIG. 11.
Figure 14:
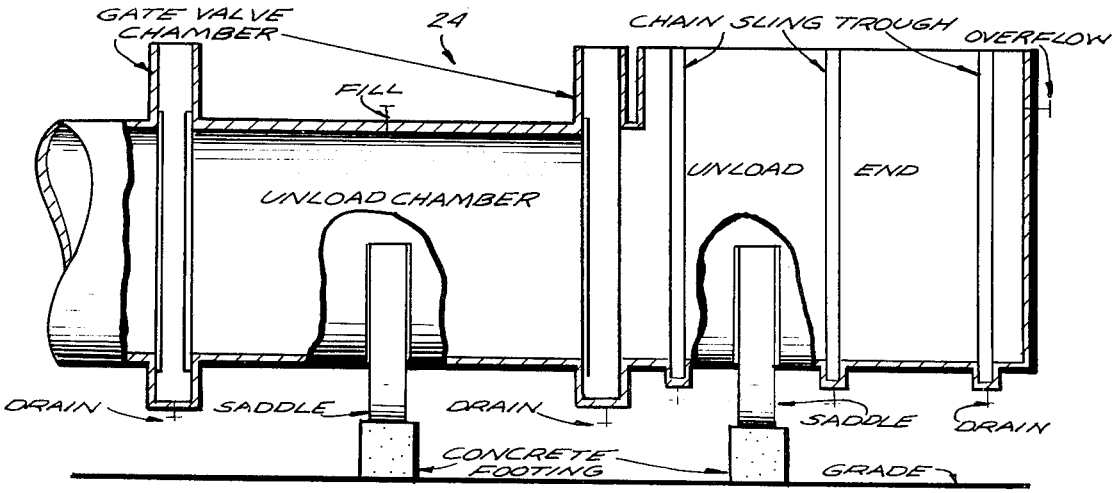
FIG. 14 is a fragmentary side elevation view of the output end of the log conditioning system.
Figure 16:
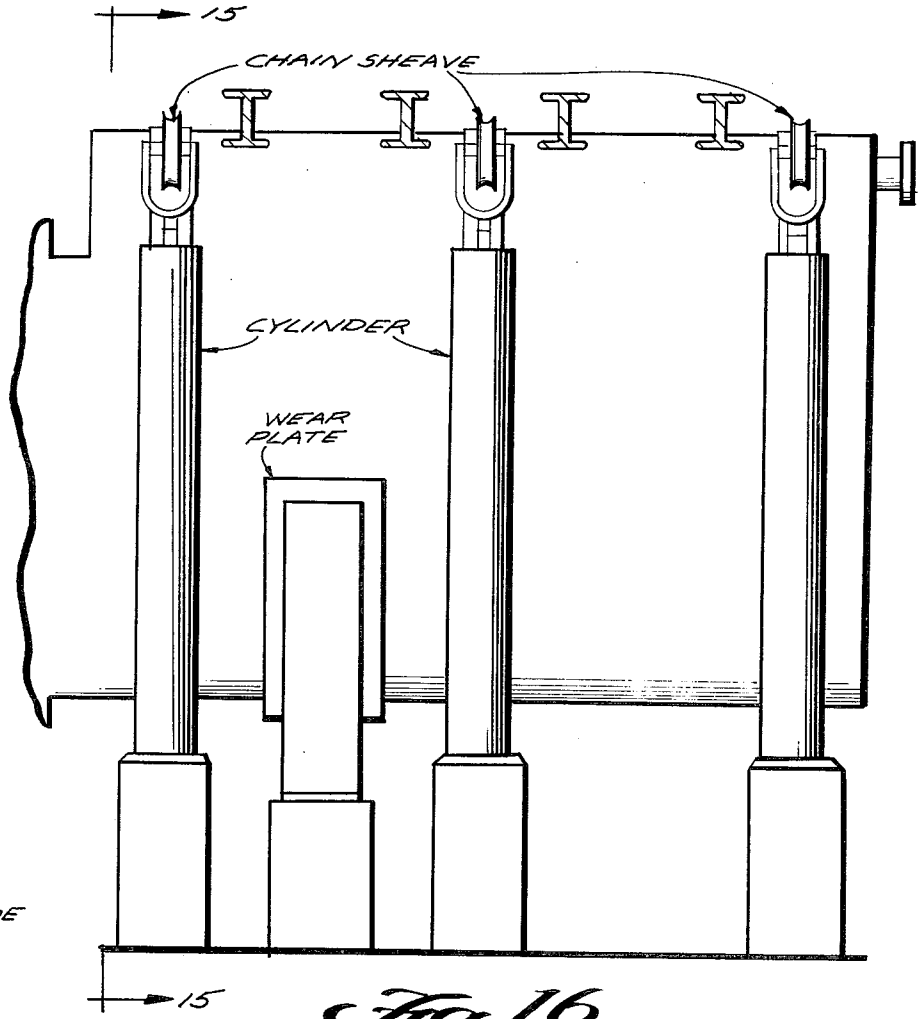
FIG. 16 is a fragmentary sectional view taken substantially on line 16—16 of FIG. 15.
Figure 15:
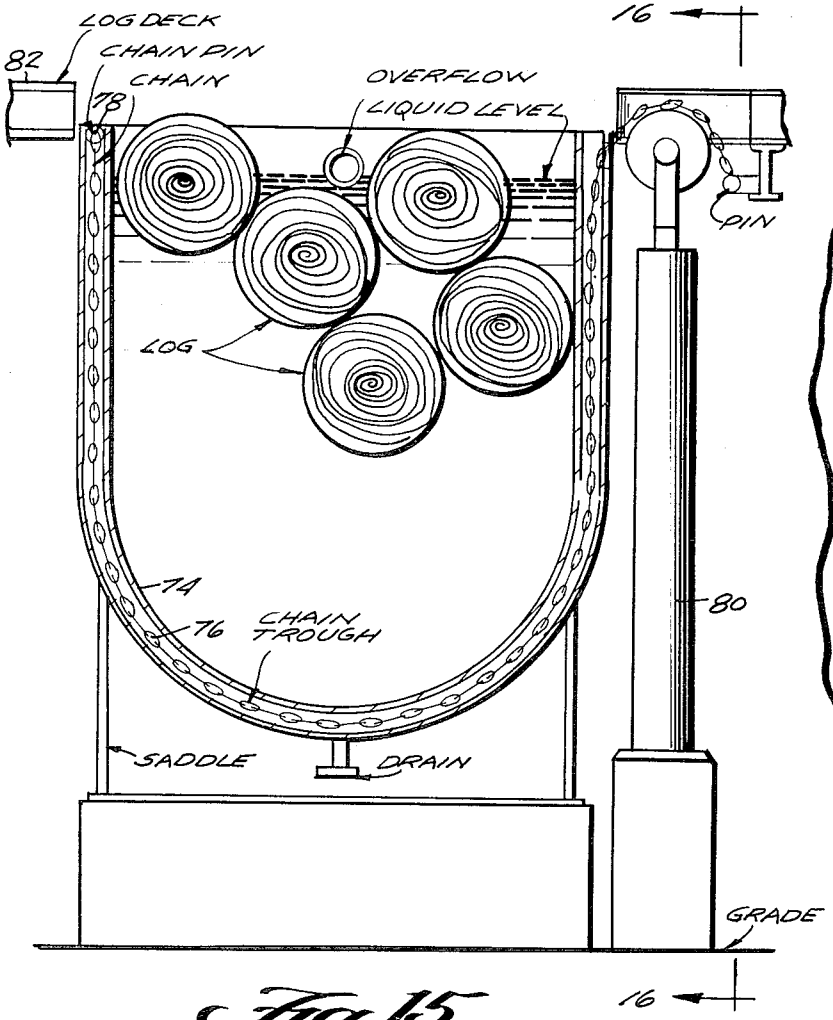
FIG. 15 is an enlarged fragmentary sectional view taken substantially on line 15—15 of FIG. 14.
Figure 17:
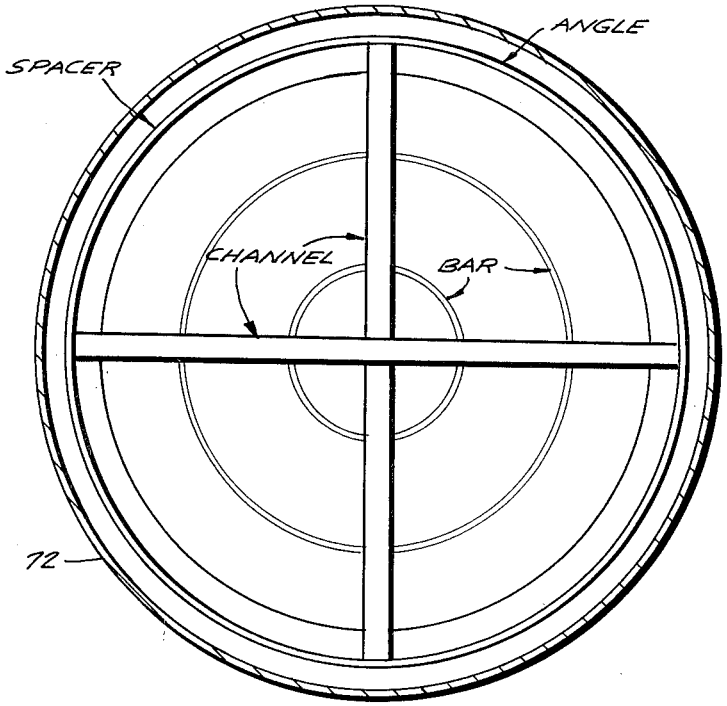
FIG. 17 is an enlarged fragmentary sectional view taken substantially on line 17—17 of FIG. 1, showing a log spacer in use in the block preparation chamber.
Figure 18:
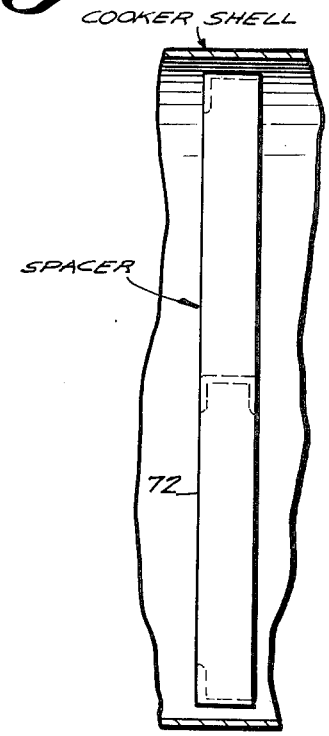
FIG. 18 is a fragmentary sectional view taken substantially on line 18—18 of FIG. 17.

At the heart of the process is a closed log conditioning chamber or cooker, typically in the form of a cylindrical steel vessel 10 mounted on supporting saddles 12, and closed at the charging and unloading ends 14, 16, by liquid- and pressure-tight openable closures such as gate valves 18, 20.

Annexed to the vessel 10 in coaxial alignment therewith at the charging end 14 is a charging chamber 22. Annexed to the vessel 10 in coaxial alignment therewith at the unloading end 16 is an unloading chamber 24.

A process control computer 26 having an active terminal for input of some process variables in schematically illustrated. Conventional devices for monitoring processing temperature are illustrated at 28, for monitoring processing pressure are illustrated at 30, for monitoring processing time are illustrated at 36. All these are schematically illustrated as being continually fed to the computer on a real-time basis. The process control computer 26 is also designed to receive manually keyed-in inputs of other process variables such as log species, ambient log temperature (which is of particular importance when the incoming logs are frozen), length of time since the logs being processed were cut, veneer quality needed, log weight and log diameter. Although no process control computer presently known to the inventor is already commercially available already programmed to receive and process the above inputs, and to control operation of the system as suggested in FIG. 2, the state of the process control computer art these days is such that the hardware and software capabilities of any of several existing suppliers can provide such a process control computer, using only state of the art knowledge, without need for experimentation or for the making of an invention.

Inlet nozzles for filling the charging chamber, the cooking chamber and the unloading chamber with processing liquid are illustrated at 38, 40, 42. Drains for emptying processing liquid from the charging chamber, the cooking chamber and the unloading chamber are illustrated at 44, 46, 48.

The charging chamber 22 typically is an upwardly opening trough 50, provided on the far side from the sloping load deck 52 with a sliding cover 53. The load deck 52 e.g. of I-beams spaced on two-foot centers is itself provided along the near side of the trough 50 with a raisable-lowerable stop gate 54. The outer end wall 56 of the trough 50 includes a bearing and seal unit 58 which sidingly, sealingly receives a longitudinally directed rod 60 for a preferably disk-shaped ram 62 which is normally stationed within the trough 50 against the end wall 56. Outside the trough 50 of the rod 60 is connected as the extension of the piston rod of an hydraulic piston and cylinder arrangement 64, which may be operated to extend and retract the piston rod, thus advancing the ram 62 completely across the length of the charging chamber trough and retracting it back against the outer wall 56 again.

The length of the charging chamber generally is equal to the length of the log or logs to be charged thereinto (for instance eight feet six inches), plus the length of the ram 62, plus a little more, e.g. one foot more, especially if the spacers (as described below) are to be installed in the charging chamber.

The stop gate 64 and the sliding cover 53 may be provided with hydraulic piston/cylinder arrangements 68, 70 or the like for moving them between their in/out and open/shut positions, respectively. These may be push-button operated by the operator, or may be automatically controlled by the process control computer 26.

The preferred practice of this first embodiment of the invention (semi-bath) contemplates the use of spacers, one between each two longitudinally succeeding charges of logs. The spacers, a typical one of which is illustrated at 72, should be generally disk shaped, almost as large in diameter as the trough 50 and cooker 10, and foraminous yet durable. It is their purpose to keep all the logs in one charge transversally lined-up with one another and not overlapping the logs of either a preceding or a succeeding charge. However, each must only sparingly contact the ends of the logs in the two charges which adjoin it, so that it does not prevent the egress of treating liquid to the log ends. Choice of material for the spacers depends in part on the magnitude of forces to be incumbent thereon in use, and also on the corrosive nature of the chemicals used in or otherwise present in the treating liquid. As an example, sometimes fiberglass-reinforced polyethylene resin or aluminum plate may be used. In other cases steel plate will be needed.

The cherry picker grabs should be shaped so as to push-down any upwardly protruding floating logs in the trough sufficiently to permit the ram 62 to smoothly push the charge of logs in the trough 50 into the log conditioning chamber 10.

The unloading chamber 24 is shown comprising a trough 74 having a chain sling 76 normally slackly resting or hanging in a catenary therein, with one end secured to an upper side edge 78 of the trough 74 and the other end mounted to an hydraulically-operated piston cylinder arrangement 80 (again, set-up to be manually or automatically operated) for raising and fastening the sling.

Beside the trough edge 78 is ranked a lathe loading hopper 82 or the like which is stationed to receive the cooked logs as unloaded from the unloading chamber by operation of the sling 76. If desired, the trough 74 and/or the lathe loading hopper 82 may be provided with openable/closeable solid covers (not shown, but similar to the cover 53) for avoiding heat loss from these areas.

The pH control system for the processing liquid typically would maintain processing liquid pH in the log conditioning chamber at about 9, using make-up water and make-up pH-adjusting chemicals as illustrated in FIGS. 1 and 2. The specific pH-adjusting chemicals to be used are not part of the present invention. In general, particularly in the paper-making industry, the range and constituency of chemicals which may be used to maintain liquor alkalinity are well-known. Of course NaOH would stand high on any list of such chemicals.

Lack of consistency in the pH control system would reduce effectiveness in log conditioning, since more and less of the cellulose would be plasticized, and more and less of soluble-in-alkaline-solution-wood resins and other wood constituents would be dissolved and leached out. The moisture range in the peeled vener would be affected, with attendant effects on redry and pressing schedules.

Submerging the logs in processing liquid surrounds the logs with an excess of what is needed to saturate them and thus automatically resaturates any dry logs. It also wets the log fibers to maximize their uptake of the treating chemicals.

Energy savings from using an enclosed system are significant. Vat evaporation losses are eliminated, steam and fuel requirements of the entire plant are reduced considerably, full plasticization of the logs cuts energy usage by cutting the overall operating time needed to convert a given amount of logs into veneer, or permits an increase in output per unit time for a given energy input. A typical Southern plywood mill may find its overall energy sufficiency increased from two to seven percent simply by replacing its present vat type log conditioning with a closed system constructed and operated in accordance with the principles of the present invention. For a typical mill turning out 88 million square feet of plywood per year, each one percent of savings may be worth about 50–100 thousand dollars per year at present (mid-1980) costs and prices.

The lengths of the various chambers 22, 10, 24 typically are based on multiples of the log lengths to be peeled on or lathes in use in the related mill. E.G. the chamber 22 could be based on one or two lengths of logs, the chamber 10 on one, two, three or more lengths of logs, and the chamber 24 on a length of logs.

In many instances, the closed system of the present invention may be installed under roof within the polywood mill itself, so that heat radiating from the shells of the chambers 22, 10, 24 will heat the mill rather than be simply lost to the outdoors.

The system may be designed so that each charge consists of one log, or of a plurality of logs, for instance one seventy-inch diameter log, or six clustered twenty-inch diameter logs. Other sizes obviously are possible based on the above principles.

Maintenance costs of other systems are saved when using the system of the present invention. There is no log dragging chain or other log conveyer chain to catch or break, no steam or hot water lines or nozzles to plug or break, no doors to be bent or broken by fork-lift truck operators, no area-separating curtains to be torn by advancing logs, no acid-produced corrosion, and the continuous flow, screening and recirulation of processing liquid limits the debris build-up problem.

Sequencing in the conduct of the process of the invention typically proceeds as follows.

Logs are debarked conventionally and brought to the loading deck 52 by grab or fork-lift and placed in a layer thereon. The stop gate 54, being in an "up" condition holds the logs on the deck until needed to fill the trough 50. The cover 53 opens, and the gate 54 is temporarily moved to its "down" condition, allowing the logs on the loading deck 52 to roll into the trough 50. The gate 50 is then re-raised. At this time the ram 62 may be operated to push the logs forwardly sufficiently in the trough so that when the ram is then retracted, two spacers 72 may be inserted between the ram and this charge of logs. The inlets 38 are opened to fill the trough 50 with treating liquid, causing the logs to be buoyed thereby. The cherry picker grabs are used to hold the logs down. At this time the cover of the unloading chamber 24, if it has one, is closed, with this chamber being flooded with treating liquid. Then the gate valves 18 and 20 are raised to interconnect the log conditioning chamber with the charging chamber and the unloading chamber. The ram 62 is then operated to push e.g. one more charges of logs from the charging chamber 22 into the log conditioning chamber 10, and to push a corresponding one or more charges of cooked logs from the log conditioning chamber 10 into the unloading chamber 24.

Then the gate valves 18 and 20 are closed. The spacers 72 and gates are so shaped, e.g. as shown, so that as the gates 18, 20 close, they each come down between a respective two spacers, again cutting off the log conditioning chamber and its contained charge or charges of logs from the charging and unloading troughs.

The charging trough begins to be loaded again as above, and the unloading trough 74 is emptied, e.g. by operating the piston and cylinder arrangement 80 to raise the cooked logs resting on the sling therein and discharge them onto the lathe loading hopper 82.

At the lathe loading hopper 82, the spacers 72 are recovered e.g. by a grab, and taken back to beside the charging chamber 22.

Figure 19:
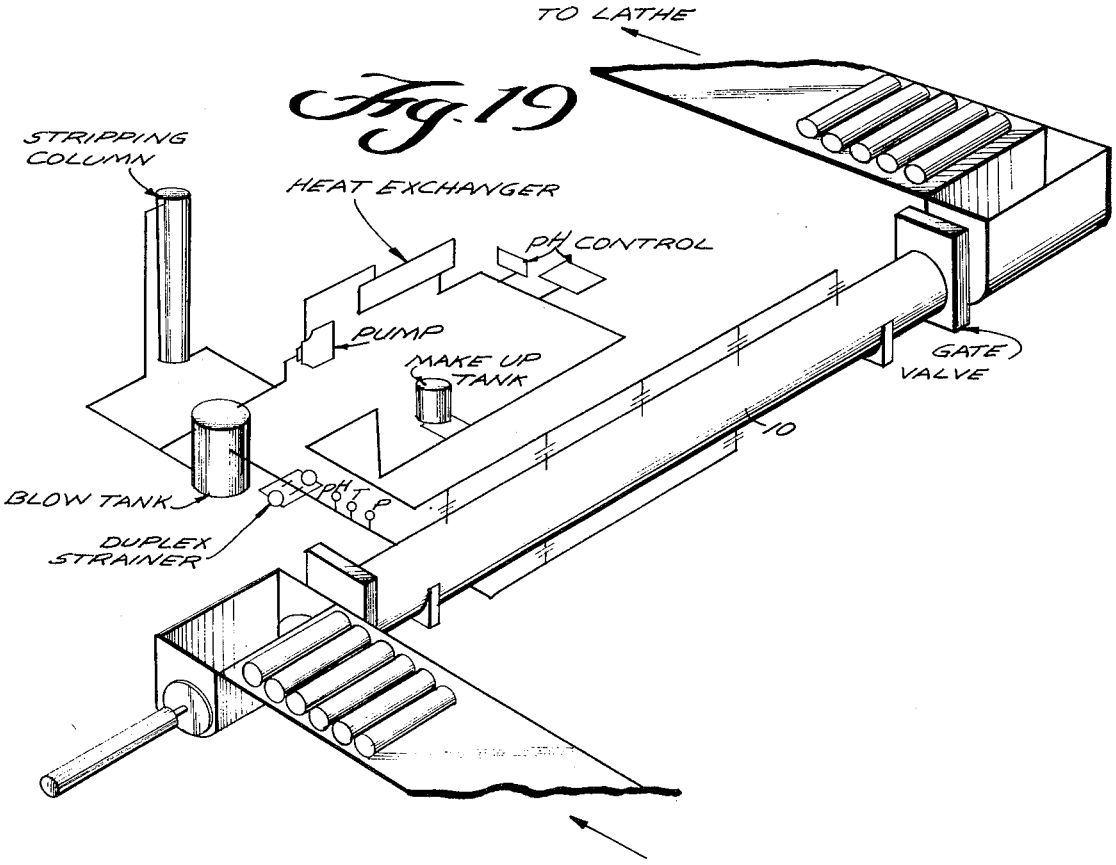
FIG. 19 is a schematic illustration, for comparison with FIG. 1, of a second embodiment of the log conditiong system, for batchwise processing.

In FIG. 19 a simpler system is shown, in which the charging and unloading chambers are eliminated and the gate valves are replaced by hinged blind flanges which can be sealed shut using locking dogs. Similar structures to the first embodiment are given like numerals, with primes.

When logs are in the treating chamber 10, it is continually flooded with treating liquid that preferably is being continually recirculated. Accordingly, treating conditions may be changed while the treatment is in progress. For example, if the logs being treated are of red oak, initial treating liquid temperature may be high, e.g., 320° F., and decreased to 180° F. over a thirty minute period. This treating temperature may then be held for e.g. thirty minutes and then dropped to 160° F. to being down the temperature of the log exterior so that when cooking time is ended the block temperature is an even 180° F. from skin to core. A typical operating pressure for the log conditioning chamber is from atmospheric to 100 psi. A typical operating temperature is from ambient to 330° F. A typical pH operating range is from neutral to 10.

As should be apparent, some of the apparatus items depicted are exempliary of other ways to accomplish the same or equivalent process steps. For instance, the sling for unloading the post-chamber trough 24 could be replaced by other means for unloading the trough, such as pivotally mounting that trough on a cradle and periodically powering a drive means to tip the trough and thus dump-out its contents.

It should now be apparent that the log preparation for veneer peeling as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A method for conditioning logs for veneer peeling, comprising:

(a) introducing a first log charge including at least one log into a log conditioning chamber through a charging opening at one end of the chamber;

(b) closing and sealing the chamber;

(c) flooding the chamber with a log conditioning liquid comprising water and an alkaline chemical present in sufficient strength to maintain a pH of at least 7 in the log conditioning liquid;

(d) while maintaining said chamber in a flooded condition, circulating said log conditioning liquid into and out of said chamber;

(e) temporarily opening an unloading opening at an opposite end of the chamber and removing said first log charge from said chamber therethrough.

2. The log conditioning method of claim 1, further comprising:

applying pressure to the circulating log conditioning liquid so that within said chamber, said at least one log is subjected to said log conditioning liquid at substantially elevated pressure.

3. The log conditioning method of claim 2, wherein:

said substantially elevated pressure is in the range of 15–100 p.s.i.g.

4. The log conditioning method of claim 1, further comprising:

adding heat to the circulating log conditioning liquid so that within said chamber, said at least one log is subjected to said log conditioning liquid at substantially elevated temperature.

5. The log conditioning method of claim 4, wherein:

said substantially elevated temperature is in the range of 140–330 degrees F.

6. The log conditioning method of claim 5, wherein:

the amount of heat added to the circulating log conditioning liquid is lowered over time, so that whereas at the beginning of said circulating said substantially elevated temperature is substantially above a preselected optimum temperature for veneer peeling of said at least one log in said first charge, and at the conclusion of said circulating said substantially elevated temperature is substantially below said preselected optimum temperature.

7. The log conditioning method of claim 6, wherein:

said substantially elevated temperature at said beginning is in the range of 300 to 330 degrees F., and said substantially elevated temperature at said conclusion is in the range of 140 to 160 degrees F.

8. The log conditioning method of claim 1, further comprising:

monitoring said log conditioning liquid pH while said log conditioning liquid is circulating into and out of said chamber, and adding make-up quantities of said alkaline chemical sufficient to maintain said pH in the range of 7–10.

9. The log conditioning method of claim 8, wherein:

said pH is maintained in the range of 9–10.

10. The log conditioning method of claim 1, wherein:

said log conditioning chamber is an elongated cylinder with said charging and unloading openings disposed at opposite ends thereof, said at least one log of said first charge being longitudinally aligned in said chamber.

11. The log conditioning method of claim 10, wherein:

said at least one log of said first charge is removed from said chamber following being conditioned therein by being displaced out said unloading opening by reopening said charging opening and pushing at least one log of a subsequent log charge into said chamber through said charging opening.

12. The log conditioning method of claim 11, wherein:

the recited log displacing step is repeatingly conducted in a cycle in which steps (a)–(e) are continually repeated on continually succeeding log charges.

13. The log conditioning method of claim 12, wherein:

said chamber, between said openings is at least as long as two log charges, so that each log charge as it is pushed into the chamber displaces a said log charge from the chamber that is longitudinally spaced from the log charge being introduced into the chamber by at least one intervening earlier-introduced log charge.

14. The method of claim 12, further comprising:

interposing at least one foraminous spacer into said chamber effectively at the head end of each said subsequent log charge, for preventing the at least one log of each respective log charge from longitudinally overlapping with the at least one log of each respective next subsequent log charge while in said chamber.

15. The method of claim 12, wherein:

the at least one log of each respectively subsequent log charge, as such log charge is about to be pushed into said chamber is first disposed in an antechamber shaped and sized similarly to said chamber in transverse section, and buoyed in a quantum of log conditioning liquid, such log charge being pushed into said chamber while so buoyed.

16. The method of claim 15, wherein:

the at least one log of each log charge becomes disposed in said antechamber by first being deposited on a table surface which dips toward said antechamber, and by having a gate temporarily moved out of the way which otherwise is normally interposed between the table surface and the antechamber, so that said at least one log of such log charge rolls off said table and into said antechamber through an open top of said antechamber.

17. The method of claim 16, wherein:

a cover normally closes said open top of said antechamber, and as a precursor to the temporary movement of said gate out of the way, said cover is temporarily raised on the opposite side of said antechamber from said table surface to act as an overshoot stop for said at least one log of such log charge as is about to roll off of said table surface and into said antechamber.

18. The method of claim 15, wherein:

said charging opening is closed and reopened by closing and reopening a gate valve stationed at said charging opening.

19. The method of claim 12, wherein:

the at least one log of each respectively preceeding log charge, as such log charge is pushed out of said chamber through said unloading opening issues into a post-chamber containing a quantum of log conditioning liquid which buoys such log charge.

20. The method of claim 19, wherein:

such log charge while buoyed in said post-chamber is underlain by a sling, and in which the at least one log charge is removed from said post chamber by raising said sling.

21. The method of claim 19, wherein:

said unloading opening is opened and reclosed by opening and reclosing a gate valve stationed at said unloading opening.

22. The method of claim 1, further including:

continuously filtering debris from said log conditioning liquid while said log conditioning liquid is circulating in step (d).

23. The method of claim 10, wherein:

the chamber is closed and sealed by rotating a respective blind flange hinged to said elongated cylinder into blocking relation with each said opening and dogging those blind flanges to opposite ends of said elongated cylinder.

24. Apparatus for conditioning logs for veneer peeling, comprising:

wall means defining a log conditioning chamber having two opposite ends;

means defining a charging opening in one of said ends and an unloading opening in the other of said ends;

openable closure means for sealingly closing each of said openings;

log conditioning liquid inlet means to said chamber for flooding said chamber with log conditioning liquid;

log conditioning liquid drain means for draining log conditioning liquid from said chamber;

a closed circulation loop for log conditioning liquid outside said chamber, connected between said log conditioning liquid inlet means and said log conditioning liquid drain means;

said closed circulation loop including means for adding make-up water to said log conditioning liquid, means for filtering debris from said log conditioning liquid, means for adding heat to said log conditioning liquid, means for adding pH-raising chemicals to said log conditioning liquid, and means for pressurizing the log conditioning liquid while said chamber is flooded therewith in order to provide a substantially elevated pressure within said chamber.

25. The apparatus of claim 24, wherein:

said log conditioning chamber is an elongated cylinder with said charging and unloading openings being disposed at opposite ends thereof, said elongated cylinder being adapted to longitudinally receive at least one log charge at a time, of at least one log per charge, with all logs of each charge being substantially longitudinally aligned with said elongated cylinder.

26. The apparatus of claim 25, wherein:

said elongated cylinder is sufficiently long as to simultaneously accommodate at least two such log charges in axially non-overlapping, generally adjoining relation.

27. The apparatus of claim 25, further including:

trough means juxtaposed with said elongated cylinder in antechamber relation to said chamber, before said charging opening, so that a log charge may be introduced into said trough while awaiting displacement into said chamber through said charging opening; and means for longitudinally displacing such charge from said trough into said chamber.

28. The apparatus of claim 27, wherein:

said displacing means is constituted by an hydraulically-operated ram.

29. The apparatus of claim 30, wherein:

said ram includes a ram head normally disposed within said trough;

said trough includes an outer end wall having a sealed bearing means therein; and said ram head is disposed on a piston rod which passes out of said trough through said sealed bearing means, while being sealingly supported thereby.

30. The apparatus of claim 27, wherein:

said trough is shaped and sized similarly in transverse cross-section;

said apparatus further including means for flooding said trough with log conditioning liquid while a log charge is disposed in said trough awaiting displacement into said chamber, to thereby float said at least one log of said log charge, so that said at least one log may be displaced into said chamber while so floated.

31. The apparatus of claim 30, further including a closeable/openable cover for said trough, and means for operating said cover.

32. The apparatus of claim 31, wherein:

said cover is slidably mounted to the trough along a side of the trough; and said apparatus further comprising:

a loading table ranked along the opposite side of said trough from where said cover is hinged, said loading table slanting down toward said trough;

a raiseable/lowerable gate interposed between the loading table and said trough to act as a temporarily removable barrier for logs piled onto said loading table;

said control means for coordinating movement of said cover and said gate, so that when a log charge is to be introduced into said trough, said cover may be slid open as said gate is temporarily removed as a barrier to the rolling of logs from said table into said trough.

33. The apparatus of claim 25, wherein:

said openable closure means are constituted by respective gate valves.

34. The apparatus of claim 25, wherein:

said openable closure means are constituted by respective blind flanges hinged to said elongated cylinder, and means for dogging said blind flanges sealingly tight against said elongated cylinder at said opposite ends thereof.

35. The apparatus of claim 27, further including:

a trough-like post chamber juxtaposed with said elongated cylinder at said unloading opening, so that as a log charge is being displaced into the chamber a respectively earlier-introduced log charge having been conditioned with said chamber may be consequently displaced from said chamber into said post-chamber.

36. The apparatus of claim 35, further including:

sling means normally slackly disposed in said post-chamber and means for raising said sling means for lifting from said post chamber such log charge as has been displaced thereinto from said chamber.

* * * * *